US010501953B2

(12) United States Patent
Courtaigne

(10) Patent No.: US 10,501,953 B2
(45) Date of Patent: Dec. 10, 2019

(54) AXIAL FLOW PUMP HAVING A NON-CIRCULAR OUTLET CROSS-SECTION

(71) Applicant: Clément Courtaigne, Paris (FR)

(72) Inventor: Clément Courtaigne, Paris (FR)

( * ) Notice: Subject to any disclaimer, the term of this patent is extended or adjusted under 35 U.S.C. 154(b) by 80 days.

(21) Appl. No.: 14/768,539

(22) PCT Filed: Feb. 25, 2014

(86) PCT No.: PCT/EP2014/053610
§ 371 (c)(1),
(2) Date: Aug. 18, 2015

(87) PCT Pub. No.: WO2014/131749
PCT Pub. Date: Sep. 4, 2014

(65) Prior Publication Data

US 2016/0002940 A1 Jan. 7, 2016

(30) Foreign Application Priority Data

Feb. 27, 2013 (FR) ..... 13 51725

(51) Int. Cl.
*E04H 4/12* (2006.01)
*A63B 69/00* (2006.01)
(Continued)

(52) U.S. Cl.
CPC ..... *E04H 4/12* (2013.01); *A63B 69/0093* (2013.01); *A63B 69/125* (2013.01); *F04D 3/005* (2013.01);
(Continued)

(58) Field of Classification Search
USPC ..... 4/491, 492
See application file for complete search history.

(56) References Cited

U.S. PATENT DOCUMENTS 4,561,133 A * 12/1985 Laing ..... A63B 69/125 4/491
4,665,572 A * 5/1987 Davidson ..... A61H 33/0091 4/491
(Continued)

FOREIGN PATENT DOCUMENTS

DE 914 802 C 7/1954
DE 24 01 040 A1 7/1975
DE 246 461 A3 6/1987

OTHER PUBLICATIONS

Search Report issued in French Patent Application No. FR 13 51725 dated Nov. 4, 2013.
(Continued)

*Primary Examiner* — Lauren A Crane
(74) *Attorney, Agent, or Firm* — Pearne & Gordon LLP

(57) ABSTRACT

The invention relates to a hydraulic pump (10) comprising a pump shaft (52) and a casing (46) delimiting a liquid circulation duct (44) in which the cross-section of the outlet orifice (12) is flattened and is oriented such that the liquid outlet direction (14) is inclined from a longitudinal axis (22) of the pump shaft passing through the casing, the casing comprising a first segment (100*a*) in which the inside surface (102*a*) has a circular cross-section centred on said longitudinal axis (22) and surrounding a pump impeller (60) supported on the pump shaft (52). According to the invention, the first segment (100*a*) has a downstream end starting from which the cross-section of the casing inside surface becomes flattened.

8 Claims, 9 Drawing Sheets

(51) Int. Cl.

| | |
|---|---|
| ***A63B 69/12*** | (2006.01) |
| ***F04D 29/54*** | (2006.01) |
| ***F04D 3/00*** | (2006.01) |
| ***F04D 13/16*** | (2006.01) |
| ***F04D 29/043*** | (2006.01) |
| ***F04D 29/18*** | (2006.01) |
| ***F04D 29/52*** | (2006.01) |
| *A63B 71/02* | (2006.01) |

(52) U.S. Cl.
CPC ..... *F04D 13/16* (2013.01); *F04D 29/043* (2013.01); *F04D 29/181* (2013.01); *F04D 29/528* (2013.01); *F04D 29/548* (2013.01); *A63B 2071/025* (2013.01)

(56) References Cited

U.S. PATENT DOCUMENTS

| | | | | |
|---|---|---|---|---|
| 2006/0026746 | A1* | 2/2006 | McFarland ..... | A63G 3/00 4/491 |
| 2008/0016610 | A1 | 1/2008 | Kuo | |

OTHER PUBLICATIONS

International Search Report issued in Application No. PCT/EP2014/053610 dated Mar. 18, 2014.
Written Opinion issued in Application No. PCT/EP2014/053610 dated Mar. 18, 2014.

* cited by examiner

AXIAL FLOW PUMP HAVING A NON-CIRCULAR OUTLET CROSS-SECTION

TECHNICAL DOMAIN

This invention is related to the field of hydraulic pumps, and particularly water pumps.

The invention is preferably but not exclusively applicable to the practice of aquatic activities requiring the creation of a current. For example, the invention can be applied to an aquatic activity zone in which water is sprayed onto a slide surface by one or several pumps so that a person on this surface can slide on the water sprayed onto it, for example using a board or a buoy or a similar product. In this type of situation, particular artificial conditions are created under which <<surf>>, <<bodyboard>>, <<wakeboard>>, etc., type sports/leisure activities are possible, or <<bodysurf>> in which the person does not have a board but slides in direct contact with the sprayed water. In this case, the slide surface can be formed preferably by defining a progressively varied slope. Alternatively, the slide surface can be horizontal, and in this case a lifting beam is preferably installed onto which the person playing on the surface can grip.

Other similar applications are also possible, for example swimming against the current, canoeing or creation of a current to push bathers along a water path, like a river. In the latter case, the bathers may or may not be equipped with a flotation means or flotation aids such as boards, buoys, etc.

The invention is intended to create wholly artificial or semi-artificial aquatic conditions in a natural water environment such as a lake, pool, river, sea inlet, etc. Another example application for the pump according to the invention is the formation of a jet in the open air, for example for a fountain.

The invention is also applicable to any hydraulic pump designed to lift or to transport water.

STATE OF PRIOR ART

There are many designs for hydraulic pumps, governed by the needs encountered. Some designs use a liquid circulation duct comprising an outlet orifice oriented such that the liquid escapes along a liquid outlet direction inclined from a longitudinal axis of the pump shaft. Moreover, in some cases, the cross-section of the outlet orifice needs to be flattened to obtain a "stretched" jet at the pump outlet. To achieve this, the circulation duct should have a variable shape because its section needs to be circular at the pump impeller.

Normally, the transition from a circular cross-section to a flattened cross-section is made at a casing outlet segment, centred on the liquid outlet direction. Specifically, a variable section adapter is usually added onto a circular outlet orifice from the pump.

This shape transition must be progressive if a high performance laminar jet is to be obtained. Moreover, once the outlet cross-section shape has been created within the circulation duct, this cross-section must be maintained over a fairly long casing length before the outlet orifice. This takes up a lot of space along the direction of the liquid outlet, such that there is scope for optimisation of this type of pump.

PRESENTATION OF THE INVENTION

Therefore the purpose of the invention is to at least partially overcome the disadvantages mentioned above found in embodiments according to prior art.

The purpose of the invention to achieve this is a hydraulic pump comprising a pump shaft and a casing delimiting a liquid circulation duct in which the cross-section of the outlet orifice is flattened and is oriented such that the liquid outlet direction is inclined from a longitudinal axis of the pump shaft passing through said casing, the casing comprising a first segment in which the inside surface has a circular cross-section centred on said longitudinal axis and surrounding a pump impeller supported on the pump shaft.

According to the invention, said first segment has a downstream end from which the cross-section of the casing inside surface becomes flattened.

Consequently, one special feature of the invention is that the cross-section is flattened well upstream in the circulation duct, at the part of the casing that surrounds the pump shaft. The result is advantageously a significant reduction in the pump dimension along the direction of the liquid outlet, while making it possible to form a high performance laminar jet at the pump outlet.

The flattened cross-section of the outlet orifice may be in any shape with a large dimension and a short dimension, the ratio between the two dimensions possibly for example being between 2 and 15. Its shape will preferably but not necessarily be rectangular or elliptical. With the rectangular general shape, the corners may be rounded and/or one or several sides may be concave or convex curves. The purpose of this flattened cross-section is to create a "stretched" laminar jet at the pump outlet, that may for example be perfectly adapted to be sprayed on a slide surface in an aquatic activity zone.

Preferably, the casing comprises a second segment formed in continuity with the first segment, the second segment having an inside surface with a variable cross-section and being arranged entirely around the pump shaft, and preferably being centred on the longitudinal axis over its entire length. In other words, this second segment does not cross the pump shaft.

Preferably, the cross-section of the inside surface of the downstream end of the second segment is identical to the cross-section of the inside surface of the pump outlet orifice. Preferably, the shape of the cross-section of the casing between this downstream end of the second segment and the outlet orifice is identical, in other words invariable. Alternatively, the cross-section of the inside surface of the downstream end of the second segment could be similar in shape to the cross-section of the inside surface of the pump outlet orifice, but either larger or smaller than the pump outlet orifice.

According to another envisaged embodiment, the cross-section of the inside surface of the downstream end of the second segment could be different from the cross-section of the inside surface of the pump outlet orifice, and in this case the casing cross section would continue to change downstream from the second segment, to reach the required flattened cross-section. This change in shape could then continue in the elements downstream from the casing, such as an elbow and/or an outlet segment.

In this respect, note that the casing preferably comprises an elbow formed in continuity with the second segment, and an outlet segment formed in continuity with the elbow. In this configuration, said elbow and the outlet segment preferably have an internal surface with the same cross section, corresponding to the cross section of the internal surface of the downstream end of the second segment. Also, the cross-section of the circulation duct does not change at all along the length of its downstream part, which provides the advantage of a long duct length such that the liquid is in very good condition for supplying a stretched laminar jet, without having any real impact on the global dimension of the pump along the liquid outlet direction.

Preferably, the pump shaft crosses said casing at the elbow.

Preferably, as mentioned above, said flattened cross-section of the outlet orifice is rectangular or elliptical in shape.

Preferably, the pump comprises a pump shaft support system installed inside said circulation duct, the system comprising a support structure fixed to the casing and a pump shaft rotational guide bearing supported by the support structure. It also comprises an opening in the casing from which a pump shaft passage conduit extends inside said circulation duct as far as the shaft support system, the pump shaft extending freely through said conduit.

In this configuration, the passage conduit is in the form of a well through which the pump shaft passes with a clearance, guided only in rotation in its portion located in continuity with the bottom of this well, by the support system bearing. Since it is not constrained by the conduit through which it passes and therefore by the casing, the pump shaft has better capacity for bending/movement than pumps according to the state of prior art to compensate for misalignment with the motor axis, without introducing excessive mechanical stress in the pump. As a result, coupling with the rotating part of the motor becomes easy, advantageously saving time. Furthermore, due to the lack of high mechanical stress created in the pump, there is no need to oversize pump parts, which results in a non-negligible saving in weight.

Also, since the invention is tolerant to any limited amplitude alignment defects between the pump shaft and the motor, fabrication tolerances can be higher with the result that manufacturing costs are lower.

Due to the guidance of the shaft at the bottom of the well, the movement/bending freedom mentioned above is obtained even when the motor is coupled to the pump shaft very close to the casing. The global dimensions of the pump along the direction of the longitudinal axis of the pump shaft can thus be particularly low.

Finally, since the mechanical stresses in the pump are lower, maintenance operations necessary to replace the most severely loaded parts are much fewer than with pumps according to prior art. In particular, the second front bearing at the casing in prior art no longer needs to be regularly replaced because it has been eliminated, and consequently, annoying noise due to premature wear of this bearing no longer occurs.

This configuration thus provides an extremely satisfactory compromise between fast and easy assembly, robustness and resistance to wear, low manufacturing and maintenance costs and limited axial dimension.

As can be seen from the above, since the shaft passes freely through the passage conduit, the pump according to the invention does not have any shaft guidance means between this shaft and the passage conduit along the entire length of the conduit. Consequently, there is no bearing or other type of means inserted between them, to facilitate movement/bending of the shaft made possible due to the presence of the radial clearance. Moreover, it is preferable if no other element is inserted between the shaft and the conduit, thus leaving the annular space between the passage conduit and the pump shaft entirely free. However, this characteristic is not limitative, since for example leak tightness means composed of seals or other means could be provided, although this is not the preferred characteristic because on the contrary, it is preferable to arrange the design such that there is a flow of cooling and/or lubrication liquid between the shaft and its passage conduit.

Moreover, since the passage conduit surrounds the shaft as soon as the casing is opened, this prevents liquid from escaping from the circulation duct where the shaft passes through the casing, or limits the quantity. Preferably, a seal is provided between the casing opening and the passage conduit, and/or between the passage conduit and the support system. Otherwise, a leak flow might occur at one and/or both of these two junctions, even if such a flow is not preferably required.

Preferably, the pump shaft is guided in rotation between one end at which it is connected with a rotating part of a pump motor and its opposite end, only by said guide bearing located in the circulation duct. In this respect, the connection end may be inserted directly in the motor rotor, or it may be coupled in rotation to a drive shaft.

Preferably, the guide bearing is permeable to the liquid so that a liquid flow can enter an annular space between the passage conduit and the pump shaft. A water-lubricated bearing is chosen in preference for this purpose. Consequently, as the liquid passes through the bearing, it performs the cooling and/or lubrication function, and possible cools the shaft along the annular space.

Preferably, said guide bearing is located close to a pump impeller supported on the shaft in the conventional form of a screw or a bladed wheel or a blisk, or in the form of any similar element.

Preferably, one end of the pump shaft is coupled in rotation with a rotating part of a pump motor preferably designed to be above the water surface, the rotating part of the pump motor preferably being coaxial with the pump shaft.

Preferably, said casing is made in two half-parts, preferably squeezing a tube between them forming said shaft conduit. In the case in which the leak tightness obtained by squeezing the tube is insufficient, leak tightness means such as a seal or a similar device can be inserted between the opening in the casing and the tube. Alternatively, instead of being added onto the casing, the conduit can be made of a single piece with one and/or the other of the two half-casing parts.

Another purpose of the invention is to obtain an aquatic activity zone designed to generate a water current using at least one such pump.

Preferably, the aquatic activity zone includes a slide surface that preferably defines a slope, a water reservoir and at least one such pump according to the invention, and preferably several of these pumps arranged side by side, each pump being fed from said water reservoir and oriented so as to spray water on said surface. This zone can thus be used to practice a "sliding" activity on the water sprayed on the slide surface.

Obviously, other applications are also envisaged, as mentioned above.

Regardless of the envisaged application, the fact of providing several pumps arranged adjacent to each other means that a high power jet can be provided while installation of the zone is facilitated. It is easier to install several individual pumps that are easy to transport and manipulate that a single high flow pump. It is also easier to install them in the water reservoir, in the sense that the global vertical size of these pumps may be limited when their pump shafts are oriented along the vertical direction.

It should also be noted that the pumps may be separated from each other by a distance dependent on the required slide width and the required jet power.

Other advantages and characteristics of the invention will appear in the detailed non-limitative description given below.

BRIEF DESCRIPTION OF THE DRAWINGS

This description will be made with reference to the appended drawings among which.

Ia

Ia

DETAILED DESCRIPTION OF PARTICULAR EMBODIMENTS

Figure 1:
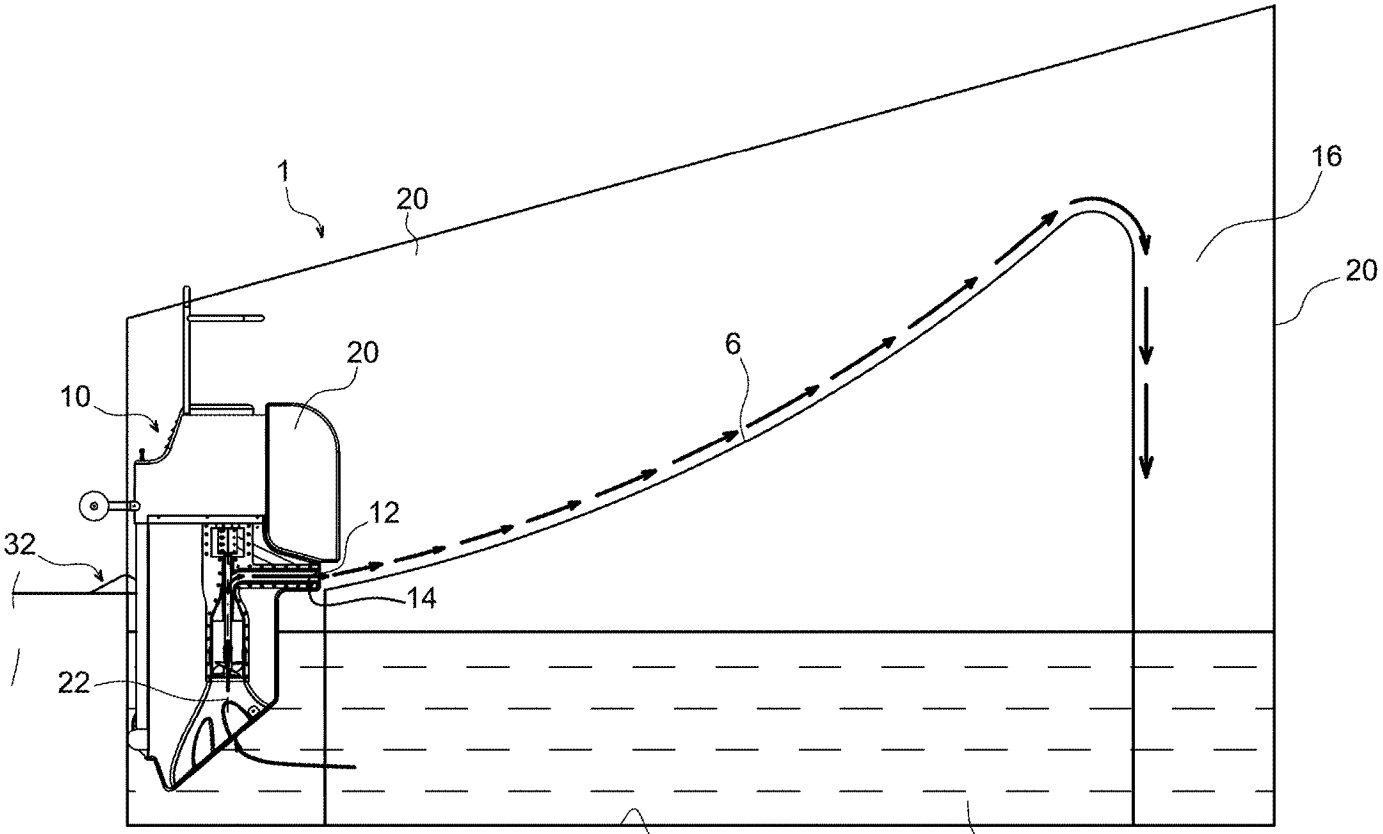
FIG. 1 shows a diagrammatic side view of an aquatic activity zone according to a preferred embodiment of this invention.
Figure 2:
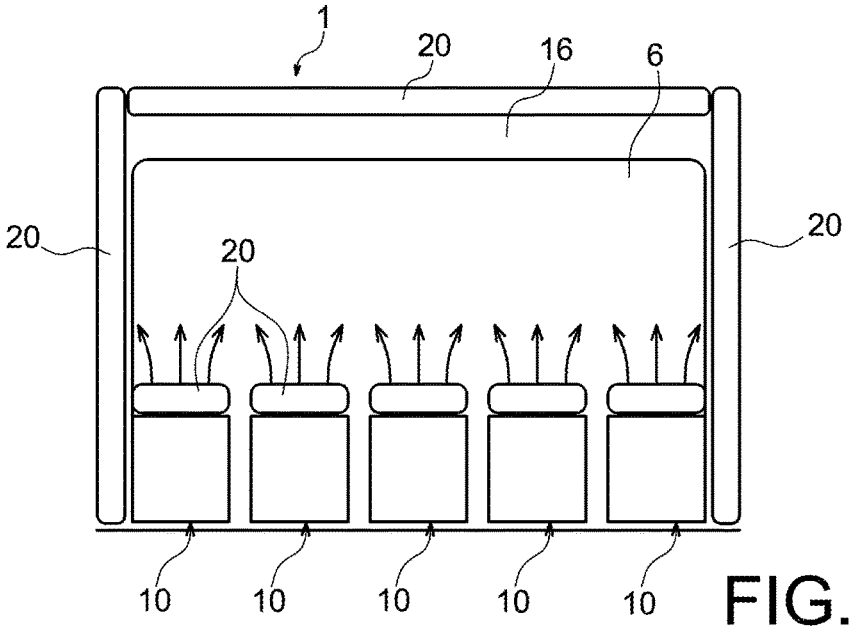
FIG. 2 shows a top view of the aquatic activity zone in FIG. 1.
Figure 3:
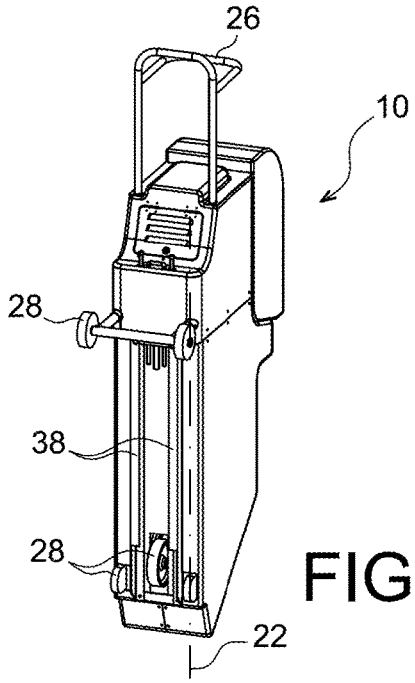
FIG. 3 shows a perspective view of one of the pumps installed in an aquatic activity zone shown in the previous figures.

Firstly with reference to FIGS. 1 and 2, the figures show an aquatic activity zone 1 according to a preferred embodiment of the invention. In this case, artificial conditions for practicing a sports or leisure activity such as <<surf>>, <<bodyboard>> or <<wakeboard>>, or any other similar activity in the domain of slides, will be created in the zone 1.

Firstly, the activity zone comprises a water reservoir 2 that in this case is retained in an artificial pool 4. In the embodiment shown, it is a wholly artificial zone 1 that can be disassembled and reassembled on site, including the pool 4. It should be noted that alternatively, the artificial pool 4 could be a fixed non-transportable artificial pool, without going outside the scope of the invention.

The zone 1 also comprises a slide surface 6, positioned above the pool 4. Alternatively, this slide surface 6 may be arranged at least partly within the pool 4, preferably in the upstream part of this pool 4.

The surface 6 defines a possibly progressive slope. This slope is preferably formed by an inflatable structure taking up the required slope, and on which a fabric is stretched to create a smooth surface on which water can easily flow. Preferably, the fabric is fixed to the inflatable structure and designed such that it becomes tensioned as the structure is inflated.

Moreover, the zone 1 comprises a plurality of pumps specific to this invention, these pumps 10 being arranged side by side along the direction transverse to the slope 6. Each pump has one part immersed in the water container 2 and is arranged facing a low point of the slide surface 6. Moreover, as can be seen in FIG. 1, the pump has an outlet orifice 12 oriented such that the liquid escapes along a liquid outlet axis 14 parallel to the low end of the slide surface 6.

Therefore during operation, each hydraulic pump 10 sprays a laminar jet 10 on the slide surface 6, water flowing from the bottom to the top of the slope until reaching an end downstream from the slope at which there is a water reception well 16 from which water is rerouted back into the pool 4. Consequently, the water circuit in the activity zone 1 is a closed circuit.

Moreover, the activity zone 1 comprises a multitude of safety elements 20 surrounding the slide surface 6 so that a person sliding on it cannot accidentally fall off it. Such safety elements 20 are preferably inflatable shock absorbing elements, or similar elements made of foam. Similar elements may be provided in front of the part of each pump 10 above the water surface, so that the person sliding on the surface 6 cannot accidently strike this pump part.

The layout of the different pumps can be adapted to the needs encountered, particularly concerning spacing, inclination, depth in the pool, or the jet orientation to create parallel and/or divergent and/or convergent jets. These parameters can be fixed at the time of assembly, or they can be changed during operation.

The outlet orifice 14 has a flattened cross-section capable of discharging a stretched water jet. A flattened section preferably refers to a generally rectangular or elliptical shaped section with major axis parallel to the generating line of the slide surface 6. Therefore this outlet orifice is oriented along the axis 14 that is inclined relative to the longitudinal axis 22 of a pump shaft (not marked in FIG. 1), this pump shaft preferably being vertical. Preferably, the inclination between axes 14 and 22 is of the order of 90°, but more generally may be between 60 and 120°, although other values could be adopted without going outside the scope of the invention, depending on needs encountered.

With reference to FIGS. 3 to 6, the figures show specific means by which each pump 10 can be placed in the pool 4, in the position shown in FIG. 1. Firstly, note that the pump is provided with gripping means 26 in the form of a handle that can be retracted into the pump when the pump is not being moved. The pump is also fitted with wheels 28 at the front and the back of this pump along the direction of the axis 22, at the bottom of the pump. Consequently, the pump can be moved along a horizontal surface 30 leading to the pool 4, running on this surface 30 by pushing or pulling on the gripping handle 26. The pump can thus be displaced by rolling with its axis 22 parallel to the support surface 30, as far as an end of the pool 4 where pump support means 32 are provided fixed to the surface 30. These means comprise two clevises 34 each supporting a guide roller 36 that fits into complementary rails 38 provided on the bottom of the pump. Consequently, when one of the front wheels penetrates between two clevises as shown on the view on the left of FIG. 5, the pump can be centred so as to make the rollers 36 correspond with the rails 38. Therefore these elements 36, 38 may engage before the pump is pivoted to be inclined at 90°, to obtain the final position in which the longitudinal axis of the pump shaft 22 is parallel to the vertical direction. This tipping operation is done while lowing the pump into the pool 4, by displacement of rollers 36 along the rails 38. This operation can be done comfortably by an operator standing up in zone 30, while manipulating the assembly using the gripping handle 26. Lowering the pump 10 is stopped when each roller 36 reaches the bottom of its corresponding rail 38, in the position shown in FIG. 1. In this position, the front wheels bear in contact with the vertical wall of the pool 4, while the weight of the pump is resisted essentially by engagement between the rollers and the rails.

Figure 7:
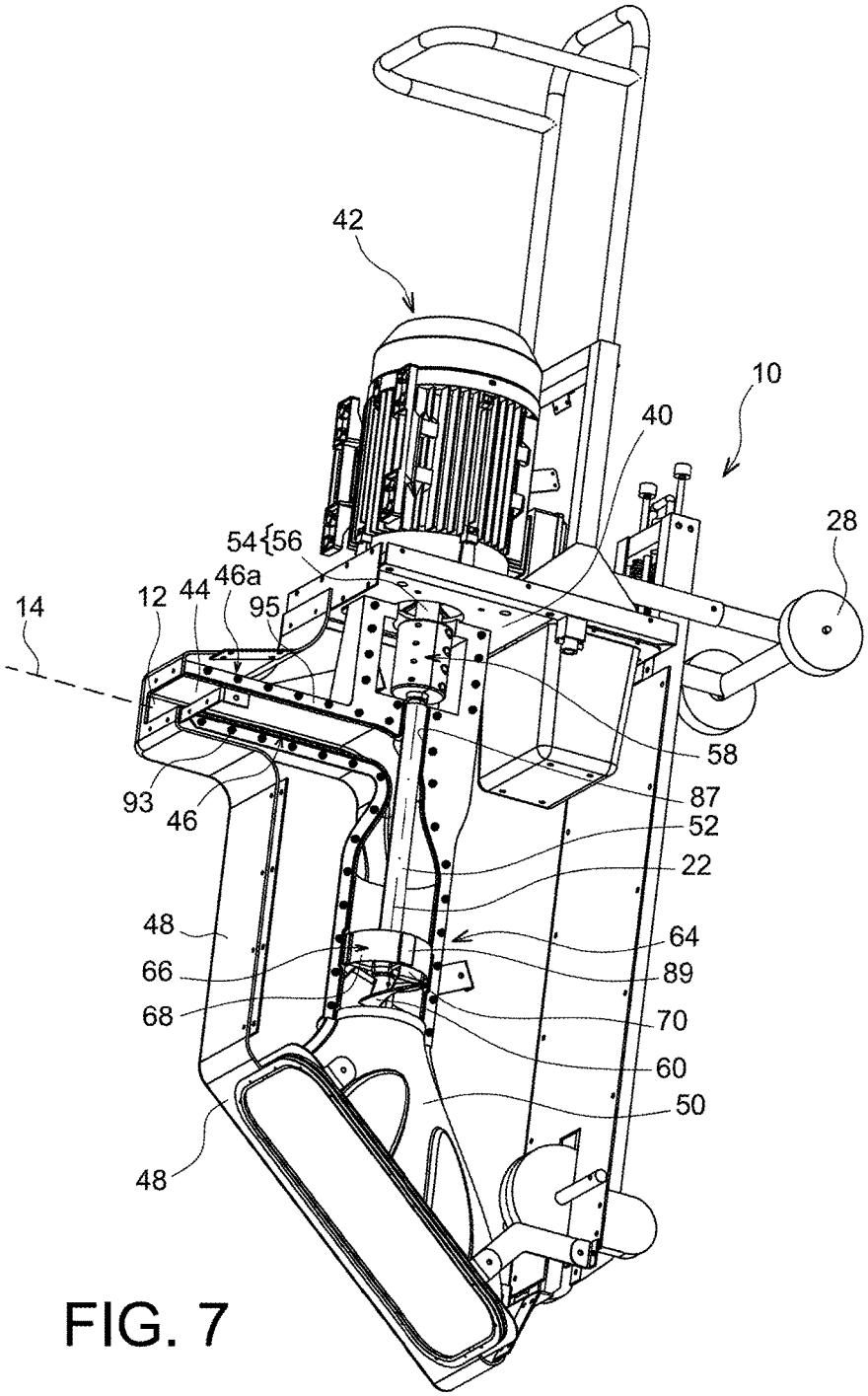
FIG. 7 shows a perspective view of the pump shown in FIGS. 3 to 6, partially cut in a plane of symmetry of the liquid circulation duct.
Figure 8:
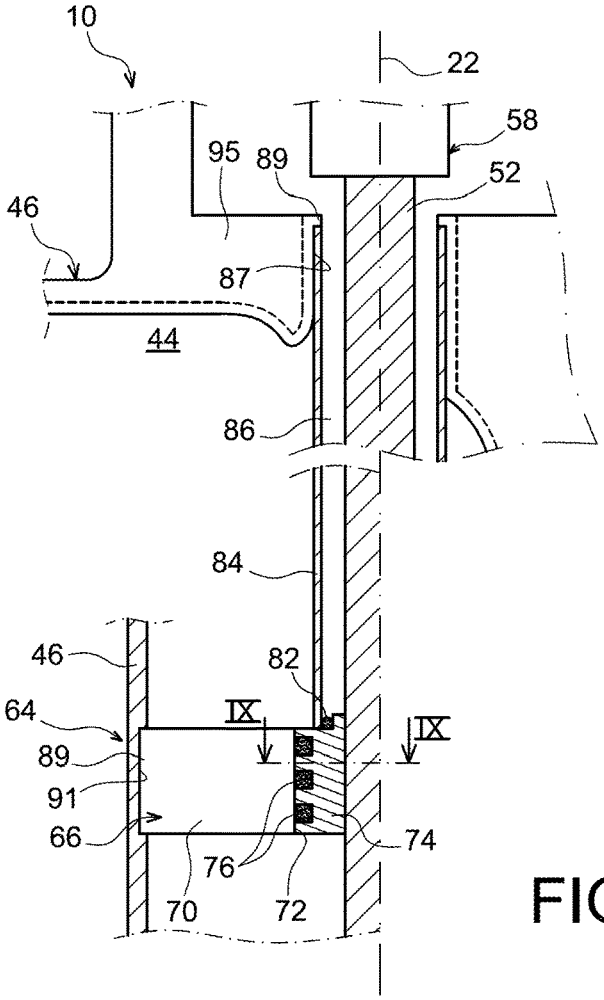
FIG. 8 shows a sectional view of a part of the pump shown in FIG. 7, this view being taken on line VIII-VIII in FIG. 9.
Figure 9:
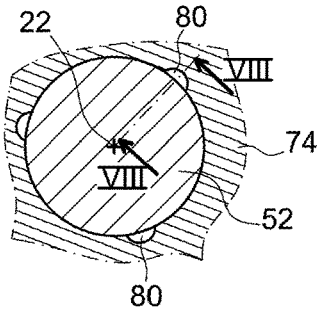
FIG. 9 is a sectional view taken along line IX-IX in FIG. 8.
Figure 10:
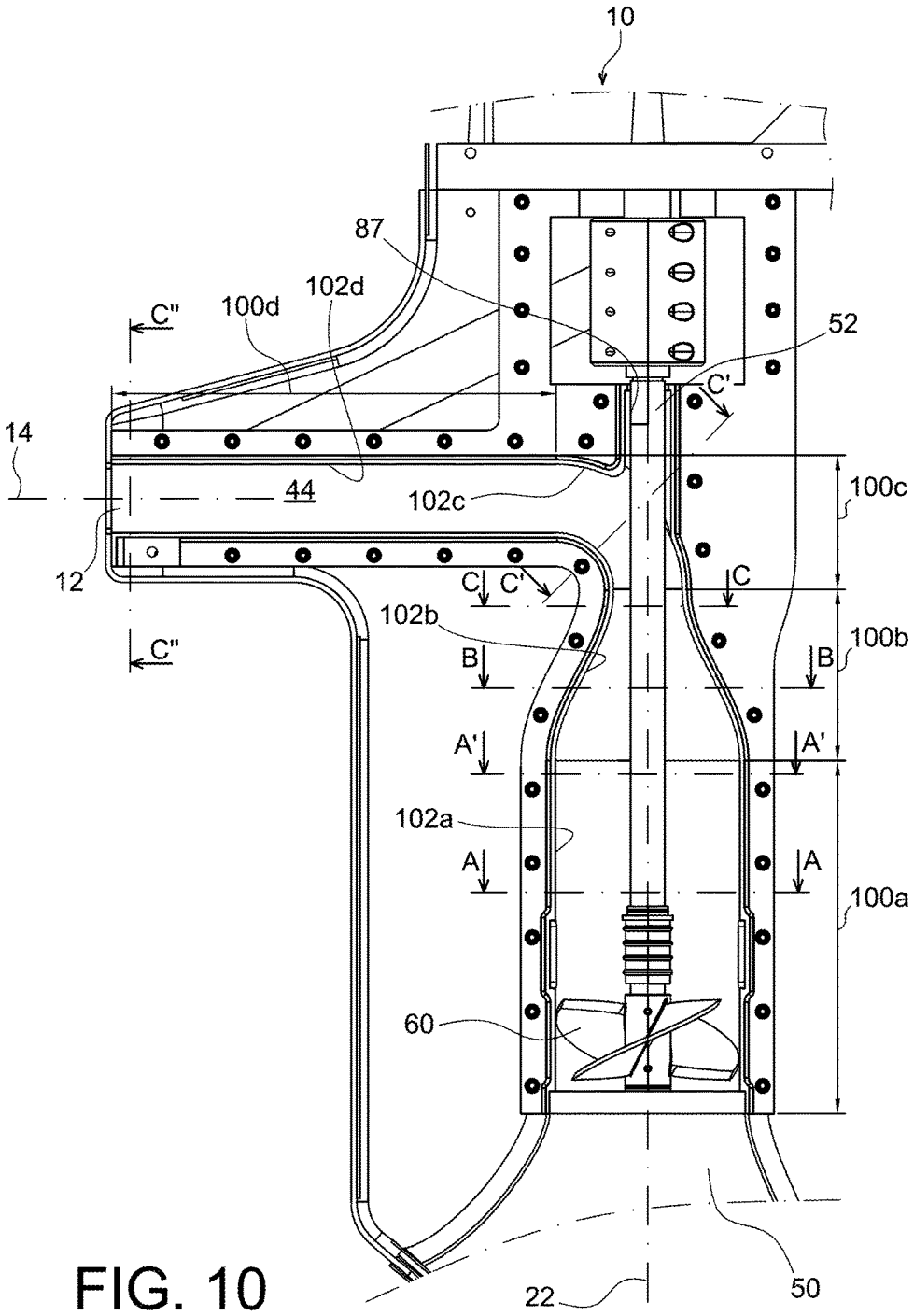
FIG. 10 is a view similar to the view in FIG. 7, on which the different segments of the liquid circulation duct have been identified.
Figure 11:
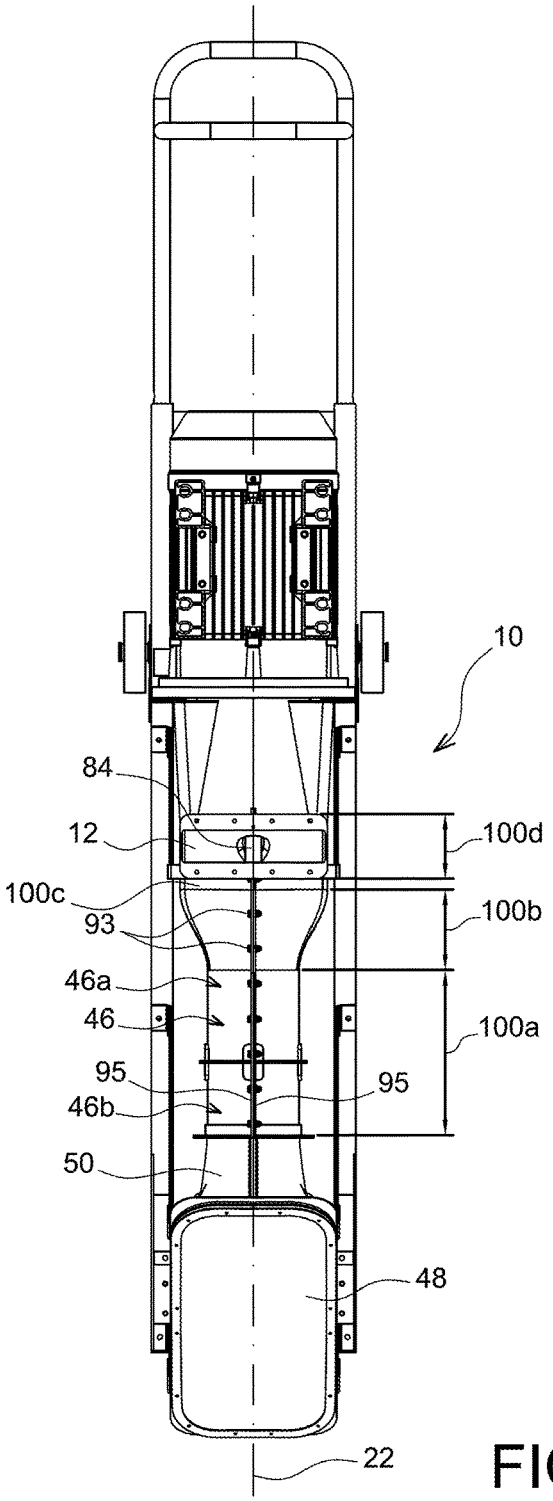
FIG. 11 is a front view of the pump shown in FIG. 10.

With reference more specifically to FIGS. 7 to 9, the figures show a part of any one of the pumps 10, each of which preferably has the same design. Note that each pump will output a high flow, for example of the order of 100 to 600 $m^3/h$.

The pump 10 is fitted with a platform 40 supporting a motor 42 below which there is a circulation duct 44 delimited by a casing 46. The part that will be above the water is the part containing the motor 42 located above the platform 40, while the part that will be immersed comprising the liquid circulation duct 44 is located under this platform 40. Not also that the pump will be covered with protective covers, both on the immersed part and on the part above the water, although they are not shown entirely. For example, the cover 48 shown in FIG. 7 surrounds the circulation duct 44 and its casing 46 that delimits it.

The outlet orifice 12 with its flattened cross-section is located at the downstream end of the circulation duct 44 in the general shape of in inverted <<L>>. The upstream end of this duct communicates with a tapered water intake 50. Therefore the shape of this intake 50 is tapered to become larger in the outwards direction, as far as a lower cover 48 through which water penetrates into this intake.

The pump 10 comprises a pump shaft 52 that is therefore oriented along the longitudinal axis 22 on which it is centred. This shaft comprises a top end called the connection end that is coupled in rotation to a rotating part 54 of the motor 42 and more precisely is coupled to an output shaft 56 from this rotating part, also called the drive shaft. The coupling is made through appropriate mechanical means 58 that are for example in the form of an Oldham joint or a universal joint. These mechanical coupling means 58 are preferably located under the platform 40. Moreover, the pump shaft 52 and the drive shaft 56 are coaxial, although a small misalignment between these two shafts can be tolerated due to the nature of the mechanical coupling means 58, and also due to the design selected for the passage of the shaft through the casing 46, as will be described below.

Moreover, the pump shaft 52 has a bottom end on which a pump impeller 60 in the form of a simple screw is fitted. This screw is located in the upstream part of the liquid circulation duct, close to the intake 50.

The shaft 52 is guided in rotation by a support system 64 comprising a support structure 66 fixed onto the casing 46. This support structure 66 comprises a shell 68 that will be placed in contact with or close to the inside surface of the casing 46, and radial arms 70 extend inwards from this shell as far as a reaming 72 with its centre on the axis 22. Moreover, the support system 66 comprises a rotational guide bearing 74 housed in the reaming 72 that supports it. This bearing 74 has an outside surface with circumferential grooves in which friction seals and seals 76 are preferably arranged, in contact with the reaming 72. The bearing 74 is located close to the bottom end of the shaft 52 supporting the screw 60. It guides this pump shaft 52 in rotation due to an inside surface with which this shaft is in contact. Preferably, it is a bearing through which a flow of cooling water and/or lubrication water can pass, in the form of a water-lubricated bearing, or water lubricated liner, or a <<hydrolube>> ring. As can be seen in FIG. 9, the hydrolube ring 74 has an inside surface with very small axial grooves 80 through which water can circulate along the shaft 52. The top end of the hydrolube ring 74 is contacted in a sealed manner, preferably through an O-ring 82, through a shaft passage conduit 84 in the form of a tube with a circular cross-section centred on the axis 22.

This tube 84 extends like a well into the circulation duct 44, starting from the casing opening 87 close to the mechanical connection means 58. Therefore the tube 84 extends vertically along axis 22 from the opening 87 to which it is connected in a leak tight manner, as far as the hydrolube ring 74 to which it is also connected in a leak tight manner. One of the special features is that the shaft 52 passes freely through the tube 84, a radial clearance being provided so that the pump shaft 52 can move and/or bend inside this tube, to be able to handle a misalignment problem between this pump shaft 52 and the drive shaft 56. The selected radial clearance and the length of the free shaft in the tube 84 from the support system 64 are such that they are capable of absorbing significant misalignments, for example of the order of one or several millimetres.

Also, the shaft 52 is guided in rotation between its connection end and its opposite end on which the screw 60 is fitted only by the hydrolube ring 74. The annular space 86 between the shaft 52 and the tube 84 is preferably left entirely free, allowing the evacuation of a very small flow of cooling and/or lubrication water introduced from the grooves 80 in the hydrolube ring 74. This flow is obviously negligible compared with the pump flow outlet through the outlet orifice 12. This flow is preferably evacuated by gravity through the top end of the tube surrounded by the casing opening 87 in a sealed manner.

Since the connection between the bottom end of the tube and the hydrolube ring 74 is leak tight, the entire flow circulating in the annular space 86 is derived from the passage of liquid through the calibrated grooves 80 in the hydrolube ring.

In this configuration, it should be noted that the pump shaft 52 is not held in place along the axial direction by the system 64, such that the pump shaft can be easily inserted/extracted during fabrication and maintenance operations. Similarly, when the motor is separated from the platform 40 and the screw 60 is pulled out from the bottom end of the pump shaft 52, the assembly composed of the motor 42 and the shaft 52 can easily be extracted/inserted axially without any other assembly/disassembly operations, simply by sliding the shaft 52 through the internal surface of the hydrolube ring 74.

The hydrolube ring 74 is preferably the only wear part in the pump, and can be replaced from the intake 50 very easily, simply by removing the screw 60 to obtain access to it.

As can be seen more clearly in FIG. 7, the casing 46 is preferably made of two parts, each of the two parts preferably being made from a single piece. These two parts are preferably symmetric about a median vertical plane of the circulation duct 44. Thus, by providing two half-parts like two half-shells, each with a half-cavity to form the casing opening 87, it is thus possible to insert the top end of the tube 84 between these two half-shells. If necessary, a seal can be made by using one or several seals between the opening 87 and the top end of the tube 84.

Note also that the opening 87 is provided with a shoulder 89 to enable axial thrust on the tube 84, to push the tube into contact with the hydrolube ring 74. Preferably, each half-shell that defines part of the duct 44 over its entire length, is made from a non-metallic material, for example plastic or a composite material. The same applies for the shaft passage tube 84 that could alternatively be incorporated in these half-shells.

It should also be noted that for the attachment of the structure 66 on the casing 46, the shell 68 is provided with radial projections 89 that fit into recesses 91 formed on the inside surface of the casing. This cooperation between the projections 89 that resemble plates and the recesses 91 prevents rotation and translation movements along the axis 22 between the casing 46 and the structure 66. This also enables precise angular indexing of the support structure 66 relative to this casing 46.

It is also shown that the hydrolube ring 74 is preferably made of brass, bronze or stainless steel.

Figure 4:
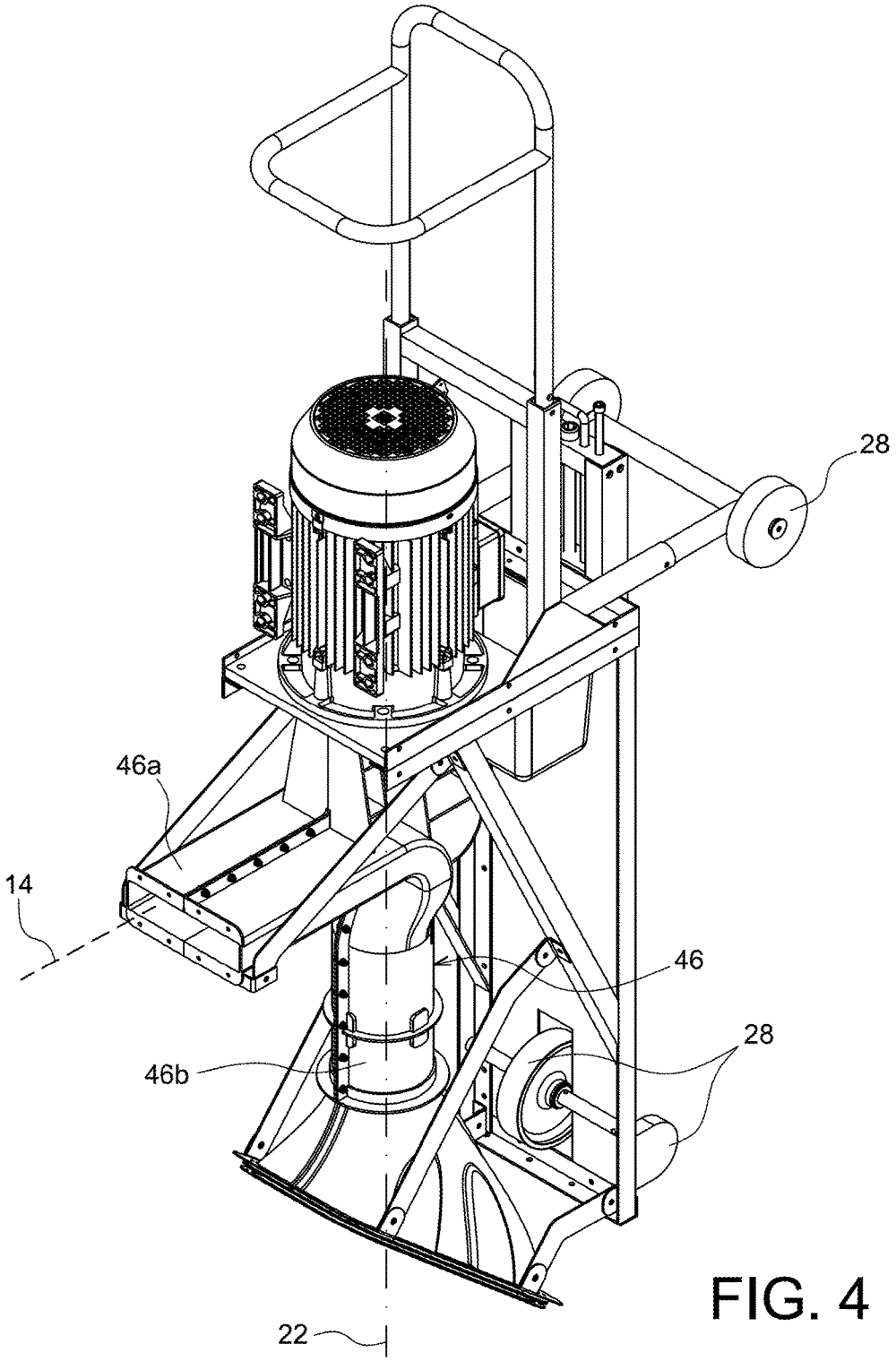
FIG. 4 also shows a perspective view of one of the pumps with some covers removed to improve visibility of the pump components.
Figure 5:
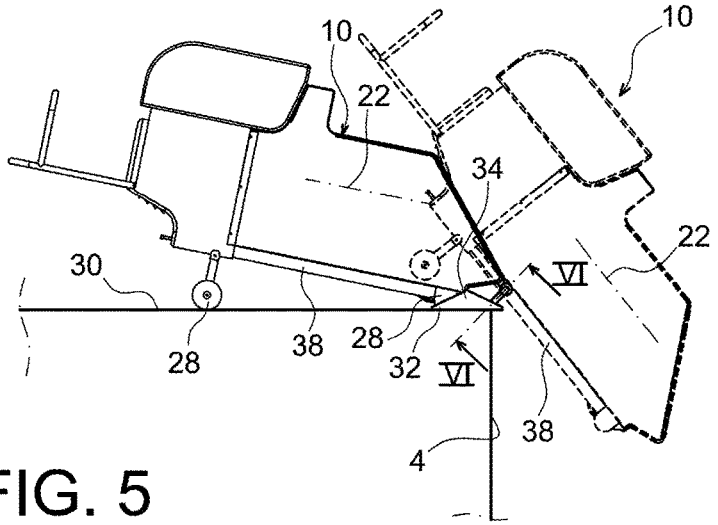
FIG. 5 is a diagrammatic view showing immersion of one of the pumps in the aquatic activity zone.
Figure 6:
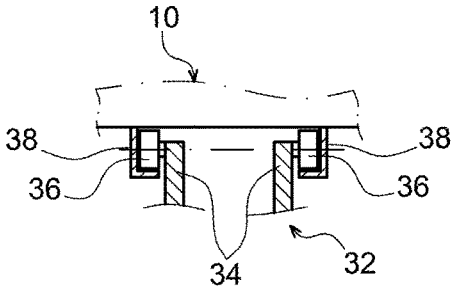
FIG. 6 is a sectional view taken along line VI-VI in FIG. 5.

As can be seen better in FIGS. 4 and 7, the casing has its two half-shells 46*a*, 46*b* that are assembled to each other by bolts 93 connecting casing flanges 95 provided on these two half-shells.

Figure 12A:
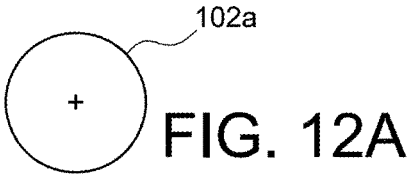
FIG. 12*a* is a sectional view taken along one of the lines A-A and A'-A' in FIG. 10.
Figure 12B:
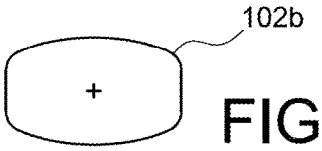
FIG. 12*b* is a sectional view taken along line B-B in FIG. 10.
Figure 12C:
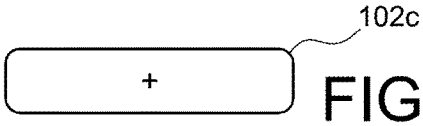
FIG. 12*c* is a sectional view taken along any one of the lines C-C, C'-C' and C"-C" in FIG. 10.

FIGS. 10 to 12*c* show details of the design of the liquid circulation duct 44. Firstly, near the bottom part, the circulation duct is defined by a first casing segment 100*a* with a constant circular cross-section, centred on the axis 22. This segment surrounds the screw 60 supported by the pump shaft 52. A second segment 100*b* is provided starting from the downstream end of this first segment 100*a*, also centred on the axis 22. This second segment 100*b* is in downstream continuity with the first segment 100*a*, and is specific in that it has an inside surface with a variable cross-section, becoming flatter towards the outlet end. FIG. 12*a* shows the shape of the cross-section of the internal surface 102*a* of the first segment, therefore this circular shape is invariable between the centre of the segment 100*a* and its downstream end. FIG. 12*b* shows the inside surface 102*b* at the centre of the second segment 100*b*, this cross-section having a flattened shape in which the large dimension is larger than the diameter of the section shown in FIG. 12*a*, and in which the small dimension along the direction of the height is less than this diameter. Thus, the cross-section of the inside surface 102*b* of this casing portion changes progressively along the entire length of this second segment 100*b* from a circular shape to a flattened rectangular shape as shown in FIG. 12*c*, corresponding to the downstream end of this second segment.

There is a 90° elbow 100*c* located in downstream continuity with the second segment 100*b*, the cross-section of this elbow remaining unchanged, with the shape shown in FIG. 12*c*. Similarly, an outlet segment 100*d* is located in downstream axial continuity of the elbow 100*c*, and also has an internal surface with a cross-section identical to that of the elbow and the downstream end of the second segment. This cross-section is then identical to the cross-section of the outlet orifice 12 located downstream from its outlet segment 100*d*. Therefore it should be understood that the inside surfaces 102*c* and 102*d* of the elbow 100*c* and of the outlet segment 100*d* have a constant cross-section with the same shape as that shown in FIG. 12*c*. Obviously, the only exception to this constant shape cross-section is at the part of the elbow containing the opening 87, although the general rectangular shape remains unchanged in elbow sections passing through this opening 87.

Consequently, in starting and completing the flattening of the cross-section of the circulation duct before the elbow through which the pump shaft 52 passes, the dimensions of the pump 10 along the direction of the axis 14 can be reduced, while producing a high performance laminar jet at the discharge from the outlet orifice 12.

Note also that, as an example for guidance only, the area of the circular cross-section in FIG. 12*a* is practically the same as the area of the outlet rectangular cross-section in FIG. 12*c*, the ratio between these areas being between 0.9 and 1.1. The variation of the ratio between the areas of the cross-sections preferably lies within this interval of values along the entire length of the circulation duct.

Obviously, those skilled in the art can make various modifications to the invention as described above only as non-limitative examples.

What is claimed is:

1. Hydraulic pump comprising a pump shaft and a casing delimiting a liquid circulation duct in which the cross-section of the outlet orifice is flattened and that is oriented such that the liquid outlet direction is inclined from a longitudinal axis of the pump shaft passing through said casing, the casing comprising a first segment in which the inside surface has a circular cross-section centred on said longitudinal axis and surrounding a pump impeller supported on the pump shaft, wherein said first segment has a downstream end from which the cross-section of the casing inside surface becomes flattened, and wherein said flattened cross-section of the outlet orifice is generally rectangular in shape, wherein the casing comprises a second segment formed in continuity with the first segment, the second segment having an inside surface with a variable cross-section and being arranged entirely around the pump shaft, and being centred on the longitudinal axis over its entire length, said casing comprising an elbow formed in continuity with the second segment, and an outlet segment formed in continuity with the elbow, the pump shaft crossing said casing at the elbow, said elbow and the outlet segment having an internal surface with the same cross-section, this cross-section being identical to the cross-section of the outlet orifice located at the downstream end of said outlet segment.

2. The pump according to claim 1, wherein the cross-section of the inside surface of the downstream end of the second segment is identical to the cross-section of the inside surface of the outlet orifice of the pump.

3. The pump according to claim 1, further comprising a pump shaft support system installed inside said circulation duct, the system comprising a support structure fixed to the casing and a rotational guide bearing of the pump shaft supported by the support structure, wherein the pump further comprises an opening in the casing from which a conduit for passage of the pump shaft extends inside said circulation duct as far as the shaft support system, and in that the pump shaft extends freely through said conduit.

4. An aquatic activity zone designed to generate a water current using at least one pump according to claim 1.

5. The aquatic activity zone according to claim 4, further comprising:

a slide surface that defines a slope; and a water reservoir, wherein the at least one pump is fed from said water reservoir and oriented so as to spray water on said surface.

6. The pump according to claim 1, wherein the circular cross-section lies on an imaginary plane that is perpendicular to said longitudinal axis.

7. The pump according to claim 1, wherein the elbow is formed downstream from the first segment.

8. The pump according to claim 7, wherein a cross-section of the inside surface upstream of the elbow is identical to the cross-section of the inside surface of the outlet orifice of the pump.

* * * * *